United States Patent [19]

Miyake et al.

[11] Patent Number: 4,863,295

[45] Date of Patent: Sep. 5, 1989

[54] PRINTER PLATEN MOTOR CONTROLLER

[75] Inventors: Tomohisa Miyake, Kanagawa; Tsutomu Kataigi, Saitama; Toshinobu Shinozuka, Tokyo, all of Japan

[73] Assignee: Tokyo Juki Industrial Co., Ltd., Tokyo, Japan

[21] Appl. No.: 88,643

[22] Filed: Aug. 12, 1987

Related U.S. Application Data

[62] Division of Ser. No. 865,032, May 5, 1986, abandoned.

[30] Foreign Application Priority Data

Sep. 20, 1984 [WO] PCT Int'l Appl. ... PCT/JP84/00453

[51] Int. Cl.[4] ..... B41J 11/00

[52] U.S. Cl. ..... 400/54; 400/551; 400/568; 400/649

[58] Field of Search ..... 400/54, 551, 568, 902, 400/577, 624, 625, 629, 630, 649

[56] References Cited

U.S. PATENT DOCUMENTS

| | | | |
|---|---|---|---|
| 3,749,221 | 7/1973 | Busch | 400/551 |
| 3,844,395 | 10/1974 | Mero et al. | 400/568 |
| 4,248,415 | 2/1981 | Steinhilber | 400/625 |
| 4,264,220 | 4/1981 | Okcuoglu . | |
| 4,286,889 | 9/1981 | Ebert et al. . | |
| 4,362,409 | 12/1982 | Endo et al. | 400/625 |
| 4,444,521 | 4/1984 | Rickard et al. | 400/568 |
| 4,544,294 | 10/1985 | Rünzi | 400/649 |
| 4,570,919 | 2/1986 | Huang | 400/649 |

FOREIGN PATENT DOCUMENTS

| | | | |
|---|---|---|---|
| 78411 | 6/1975 | Japan . | |
| 47423 | 11/1980 | Japan . | |
| 138964 | 8/1982 | Japan | 400/568 |
| 16215 | 3/1983 | Japan . | |
| 55774 | 3/1984 | Japan | 400/551 |
| 95182 | 6/1984 | Japan | 400/551 |

OTHER PUBLICATIONS

T. M. Paulson; "Automatic Platen Indexing System"; *IBM Tech. Disc. Bull.;* vol. 18, No. 10, p. 3352; Mar. 1976.

J. V. Mizzi; "Keyboard Printer w/Paper Advance from Print Obscuring Position"; *IBM Tech. Disc. Bull.;* vol. 18, No. 11, pp. 3765–3766; Apr. 1976.

A. H. Garcia et al.; "Printline Visibility in an Impact Printer"; *IBM Tech. Disc. Bull.;* vol. 23, No. 4, p. 1315; Sep. 1980.

*Primary Examiner*—David A. Wiecking

*Attorney, Agent, or Firm*—Tarolli, Sundheim & Covell

[57] ABSTRACT

A printer which is so constructed as to automatically detect deviation of a printing type when a deviation detecting command signal is detected and to automatically adjust paper feed immediately after a pause mode is released.

3 Claims, 6 Drawing Sheets

PRINTER PLATEN MOTOR CONTROLLER

This is a divisional of co-pending application Ser. No. 865,032, filed on May 5, 1986, now abandoned.

The present invention relates to a serial printer and, more particularly, to step-out detection and paper feed compensation.

BACKGROUND ART

A conventional open-control daisy wheel printer has a construction comprising, as shown in FIG. 1, a platen 1, a carriage assembly 2 for determining a printing position, a belt 3 for driving the carriage assembly 2, a daisy wheel 5 having types *5a, 5b, 5c* . . . respectively formed at the ends of spokes, a stepping motor 6 for rotating the daisy wheel, and a hammer 7 for applying printing pressure to the type. In such a printer, the printing position is determined by the carriage assembly 2, the daisy wheel 5 is rotated by the stepping motor 6 to select the printing type, and then the printing type at one end of a spoke is struck on the back side thereof by the hammer 7 and caused to hit the printing paper 8 on the plten 1 whereby its impression is printed thereon.

In a printer of this kind, in order to confirm whether or not the printing type is accurately selected (hereinafter called "detection of deviation"), it is conventional for a reference position of the daisy wheel 5 to be determined in correspondence with a given type (for example, "W" which is hereinafter called "a reference position character") so that detection of deviation is carried out each time "W" is printed.

In more detail, conventional detection of deviation is carried out by employing the construction shown in FIG. 2. In these drawings, like parts are denoted by the same reference numerals. In the construction of FIG. 2, a sensor device 13 comprising a light emitting element 11 and a light receiving element 12 is fixed securely on the carrier assembly 2. Further, secured on a rotary shaft 15 of the stepping motor 6 is a sensor bar 16 which is so positioned as to obstruct the light path of the sensor device 13 when said reference position character (for example, "W") is selected to occupy the position to be struck by a hammer stem 17 of the hammer 7. FIG. 3 shows the sensor bar 16 in a perspective view. The sensor bar 16 rotates integrally with the rotary shaft 15.

In other words, the stepping motor 6 rotates the daisy wheel 5 sequentially in response to printing character information and sequentially selects types in correspondence with the printing type information. In the absence of deviation, when the daisy wheel 5 is rotated to select the type "W" in correspondence with the printing type information ¢W", the sensor bar 16 obstructs the light path and, therefore, a sensor signal is outputted by the sensor device 13. In the presence of deviation, however, even when the stepping motor 6 rotates the daisy wheel 5 in correspondence with the printing character information "W", the type "W" is not selected and the sensor bar 16 does not obstruct the light path of the sensor device 13. Therefore, the sensor signal is not outputted, whereby the deviation is detected.

In the conventional deviation detecting device of this kind, however, detection of deviation is only performed when said reference position character is printed. Accordingly, the conventional deviation detecting device of this kind has the disadvantage that it cannot carry out detection of deviation in the case of printing continuously printing character information which does not include said reference position character.

Further, in the conventional deviation detecting device, paper feed immediately after turning on a power source switch 20 (shown in FIG. 4) causes misalignment of printing lines due to deviation in position between a rotor and an exciting coil of a paper feed motor (not shown) and/or backlash of gears for transmitting a turning force to the platen. That is, the conventional deviation detecting device has the disadvantage that the interval between adjacent printing lines can lose its uniformity, as shown by 21 in FIG. 4, to thereby cause misalignment in printing lines.

In order to obviate this disadvantage in the conventional printer, compensation for this misalignment (hereinafter referred to as "paper feed compensation") is carried out immediately after switching on the power or the acceptance and execution of a reset command from the outside. That is, printing is performed after the paper feed has been adjusted by forwardly rotating the paper feed motor by several steps and then reversely rotating it by the same number of steps.

In performing a printing operation with such a printer, it is conventional to stop the printer printing (hereinafter called the "pause38 mode) even after turning on the power, or to manually operate a platen knob 22 to thereby determine the printing line position or the printing page.

However, in the case where the paper feed device is driven manually with the printer in pause mode, the conventional device shows a disadvantage of misalignment in printing lines because the paper feed device is not adjusted (no compensation for the misalignment is made).

Accordingly, an object of the present invention is to provide a printer which is capable of performing detection of deviation of the daisy wheel even when continuously printing a series of printing character information which does not include a reference position character.

Another object of the present invention is to provide a printer which is capable of automatically adjusting the paper feed device by paper feed compensation even immediately after termination of a pause mode of the printer.

DISCLOSURE OF INVENTION

The present invention is characterized in that it is so constructed as to automatically detect deviation of the printing type when a detection of deviation command signal is detected and to automatically perform paper feed compensation immediately after the pause mode is released.

BEST MODE FOR CARRYING OUT THE INVENTION

Figure 5:
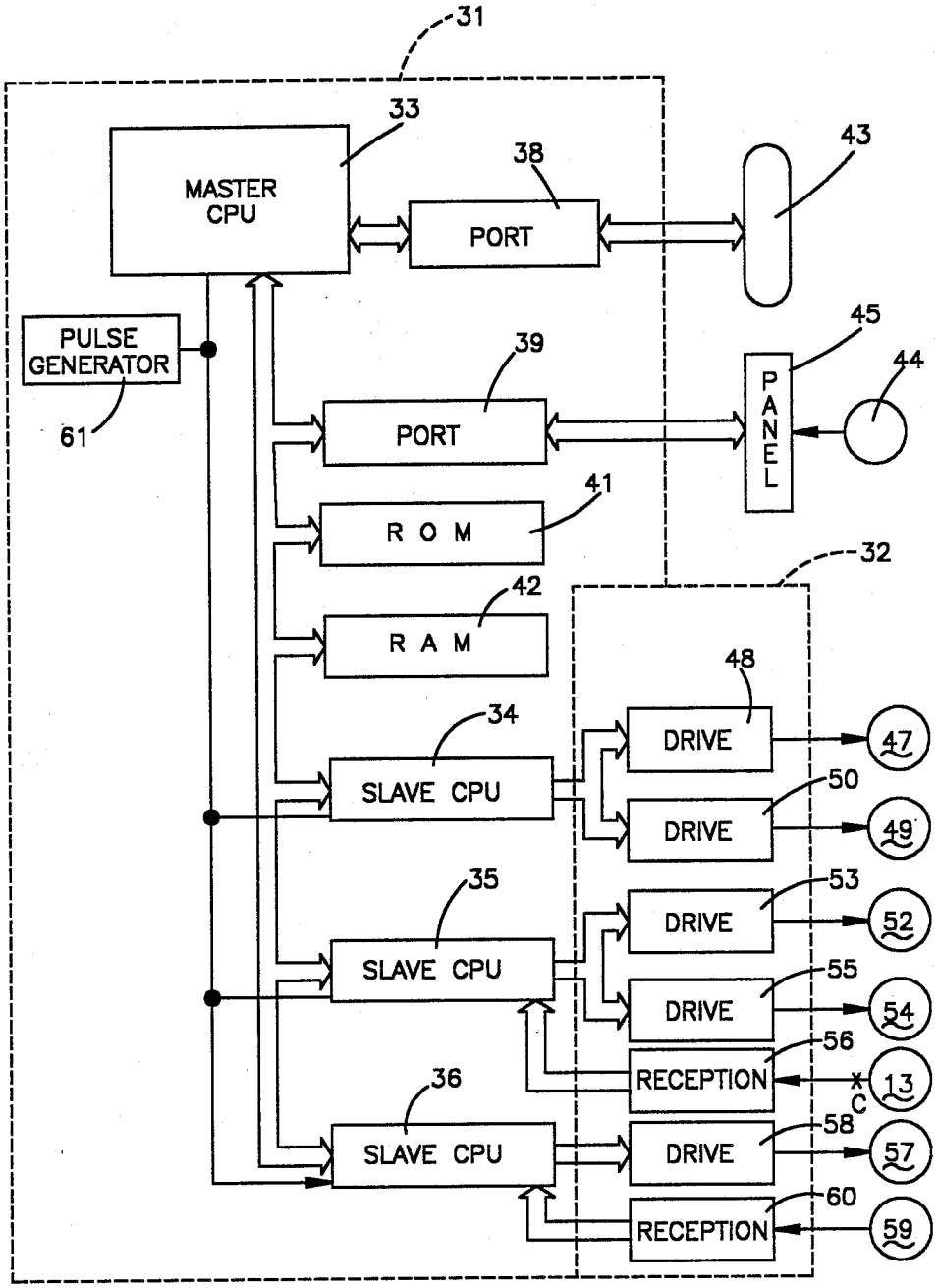
FIG. 5 is a block diagram of essential portions of one embodiment of the present invention.

An embodiment of the present invention will now be described in detail with reference to the drawings, in which FIG. 5 is a block diagram of essential portions of one embodiment of the present invention. The embodiment of FIG. 5 comprises mainly a control unit 31 and drive units 32 for respective motors. In the control unit 31, connected to a master CPU 33 are slave CPU's 34, 35 and 36, ports 38 and 39, a ROM 41 having a control program of the present apparatus stored therein, and a RAM 42 having data stored therein. An input device (not shown) for printing character information or the like is connected to the port 38 through an interface circuit 43. Connected to the port 39 is a control panel 45 provided with various functional switches including a pause switch 44.

Connected to the slave CPU 34 are drive circuits 48 and 50 for driving a paper feed motor 47 and an ink ribbon feed motor 49, respectively.

Connected to the slave CPU 35 are drive circuits 53 and 55 for driving a daisy motor 52 (the stepping motor 6 in FIG. 1) rotating the daisy wheel 5 (FIG. 1) and a hammer magnet 54, respectively. Further, a reception circuit 56 for receiving sensor signals from said sensor device 13 (FIG. 2) is connected to the slave CPU 35.

Figure 1:
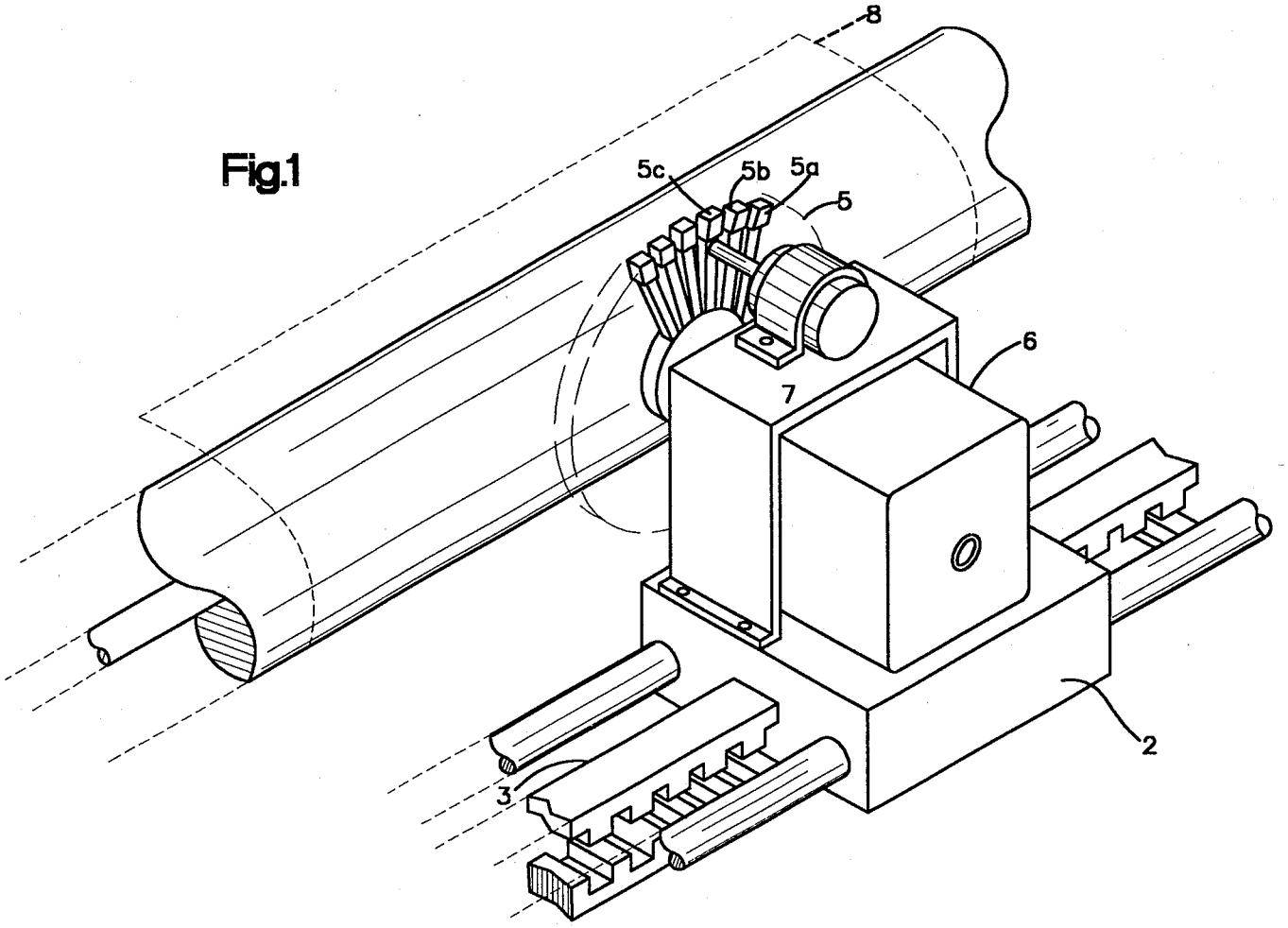
FIG. 1 is a perspective view of essential portions of a daisy wheel printer.
Figure 2:
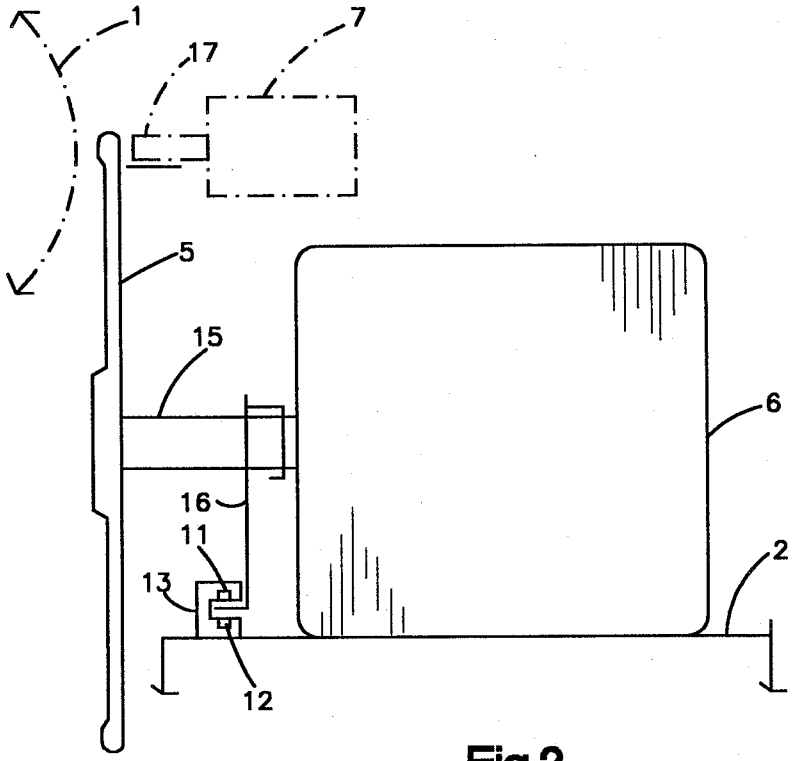
FIG. 2 is a side view of essential portions of a deviation detecting device.
Figure 3:
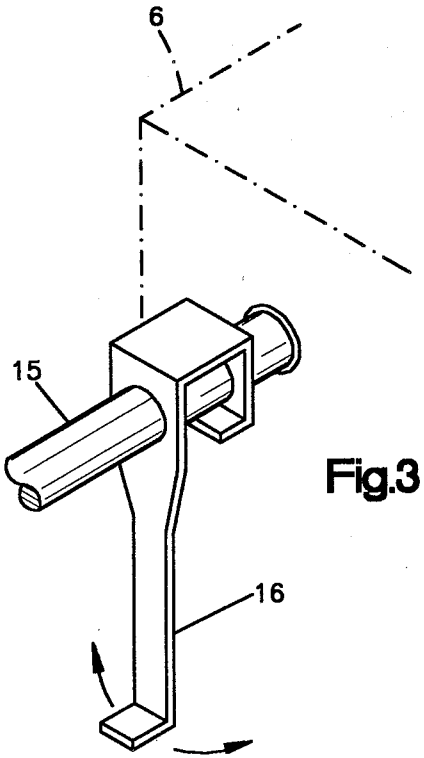
FIG. 3 is a perspective view of a sensor bar.

Connected to the slave CPU 36 is a drive circuit 58 for driving a carriage motor 57 moving the carriage assembly 2 (FIG. 1).

In FIG. 5, reference numeral 61 denotes a pulse generator for generating a reference clock signal of 6 MHz, 59 denotes a sensor device provided at the reference position of the carriage assembly 2 and 60 denotes a reception circuit.

Figure 6:
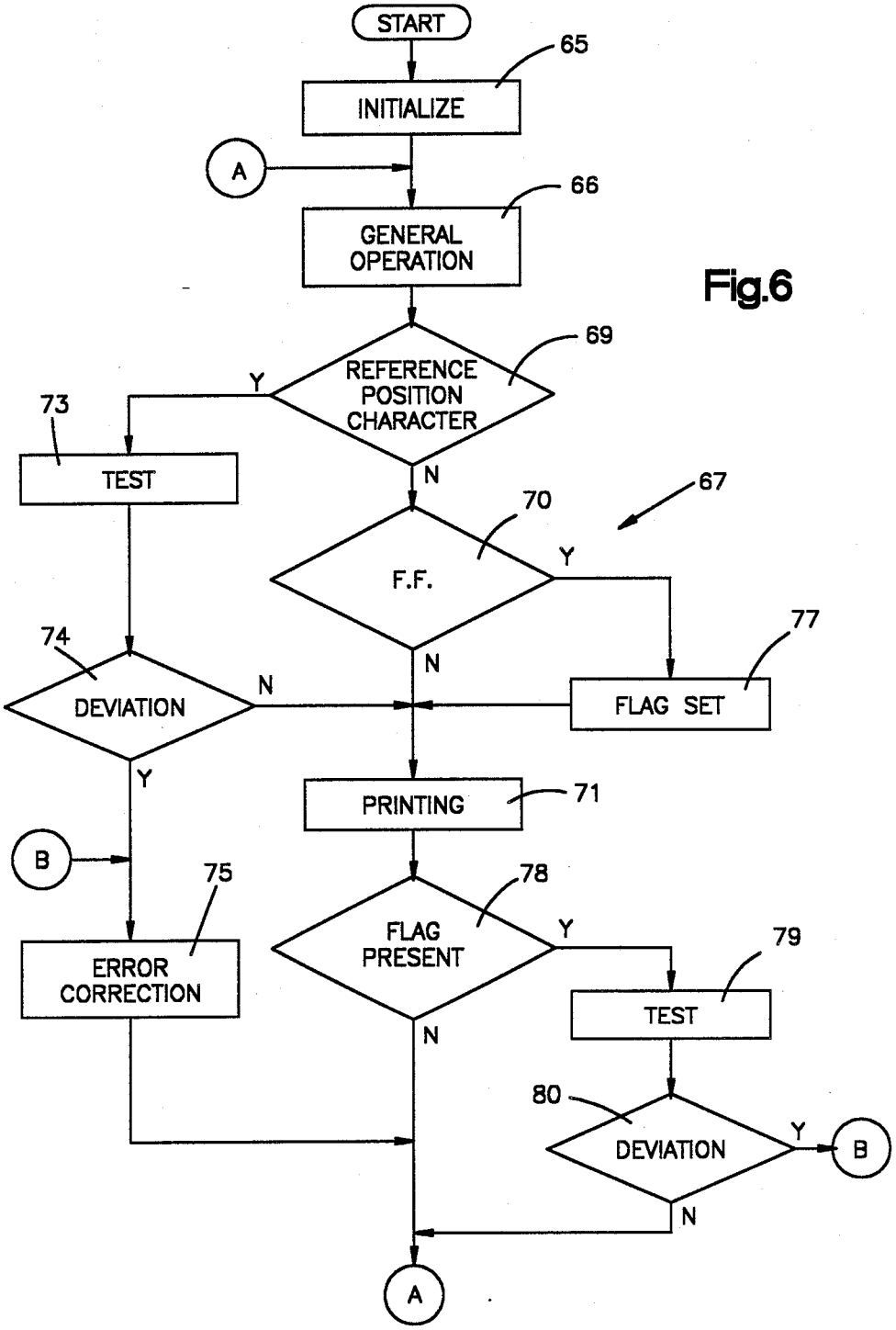
FIG. 6 is a flow chart of detection of deviation in said one embodiment of the present invention.

FIG. 6 is a flow chart of a daisy wheel deviation detecting device in one embodiment of the present invention.

Figure 7:
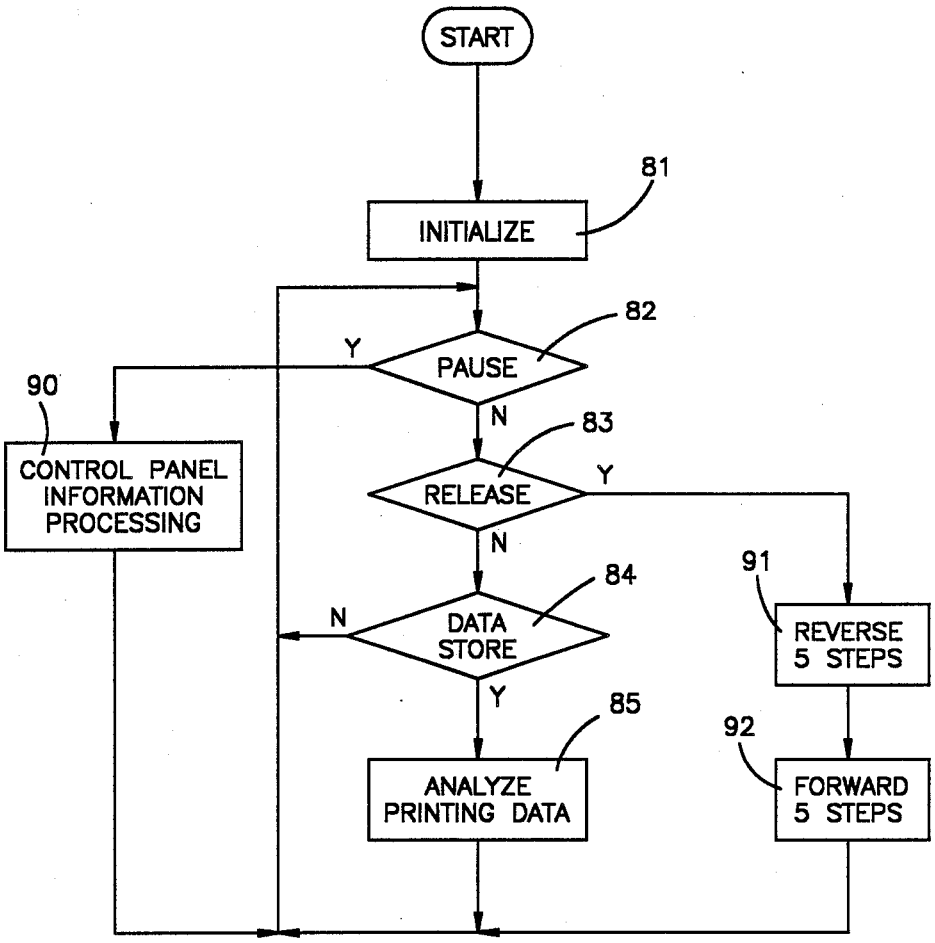
FIG. 7 is a flow chart of paper feed compensation in said one embodiment of the present invention.

FIG. 7 is a flow chart of a paper feed compensation device in one embodiment of the present invention.

Characteristic operation of the daisy wheel deviation detecting device according to said one embodiment of the present invention having the above-described construction will now be described with reference to FIGS. 1, 2, 3, 5 and 6. While blocks 65 and 66 shown in FIG. 6 are executed, they will be described only briefly because they are not included in the characteristic portion 67 of the present invention. The master CPU 33 initializes the printer (block 65 of FIG. 6) in accordance with the program (based on the flow chart of FIG. 6) stored in the ROM 41. That is, the master CPU 33 applies the initialization data to the slave CPU's 34, 35 and 36 which, in response thereto, initialize the respective devices.

At this time, the slave CPU 35 drives the daisy motor 52 so that the reference position character is selected and moved to the printing position. In this state, if the sensor bar 16 obstructs the light path of the sensor device 13 a sensor signal (L level signal) is outputted by the sensor device 13 and the master CPU 33 decides that there is no deviation. However, if there is no sensor signal outputted, the master CPU 33 receives no sensor signal from the slave CPU 35 and decides there is deviation, and proceeds with an error correcting operation.

If there is no deviation, the general operations are performed (block 66 of FIG. 6). That is, the master CPU 33 checks whether or not the printing character information is stored in the RAM 42 from an input device (not shown) through the interface circuit 43 and the port 38, and if stored in analyzes the printing character information (for example, $\alpha$) and provides data necessary for printing, such as paper feed data, printing charcter data, printing position data and the like, to the slave CPU's 34, 35 and 36, respectively. On the basis of these data, the slave CPU's 34, 35 and 36 drive the paper feed motor 47, the ink ribbon feed motor 49, the daisy motor 52, and the carriage motor 57 through the drive circuits 48, 50, 53 and 58, respectively, to set the carriage assembly 2, the daisy wheel 5 and the like at positions corresponding to the printing character information (for example, $\alpha$).

At this time, the master CPU 33 analyzes the next printing character information (for example, $\beta$) on the basis of the printing character information ($\alpha$) immediately prior to it. During this analysis, the master CPU 33 decides whether or not said immediately prior printing character ($\alpha$) is the reference position character (block 69 of FIG. 6) and whether or not said immediately prior printing character information ($\alpha$) is F.F. information (that is, Form Feed information that is, changing page information) (bloc 70 of FIG. 6). This block 70 is a characteristic feature of the present invention.

If the printing character ($\alpha$) to be printed is not the reference position character or the F.F. information, the hammer magnet 54 is driven to print the printing character ($\alpha$) (blocks 69, 70 and 71 of FIG. 6) and the operations described above are repeated.

If the printing character ($\alpha$) to be printed is the reference position character, detection of deviation of the daisy wheel 5 is performed (block 73 of FIG. 6). That is, the sensor 16 is secured to the rotary shaft 15 so as to obstruct the light path of the sensor bar 13 when the printing character is the reference position character. Accordingly, the master CPU 33 decides whether or not a sensor signal C (denoted by x in FIG. 5) is outputted from the sensor device 13. If the sensor signal C is outputted and there is no deviation (block 74 of FIG. 6), the hammer magnet 54 is driven to print the printing character ($\alpha$) (block 71 of FIG. 6).

If the printing character ($\alpha$) to be printed is the reference position character and the sensor signal C is not outputted so that deviation is detected (blocks 69, 73 and 74 of FIG. 6), error correction is performed (block 75 of FIG. 6). That is, printing is stopped and the daisy wheel 5 is started again.

If the printing character ($\alpha$) to be printed is F.F. information, a deviation detection flag is set (blocks 69, 70 and 77 of FIG. 6) and, subsequently, F.F. operation is performed (block 71 of FIG. 6). Further, it is decided that the deviation detection flag has been set (block 78 of FIG. 6), the daisy wheel 5 is driven to select the reference position character, and detection of deviation is performed in the manner described above (block 79 of FIG. 6). If deviation is detected the error correction described above is performed (blocks 75 and 80 of FIG. 6). If deviation is not detected, the flow is returned to block 66 and the operations described above are repeated (block 80 of FIG. 6).

In the present invention, in this manner, accurate printing can be peformed because deviation of the daisy wheel 5 is automatically monitored not only when the printing character is the reference position character but also periodically (in this embodiment, for each F.F. information).

Figure 4:
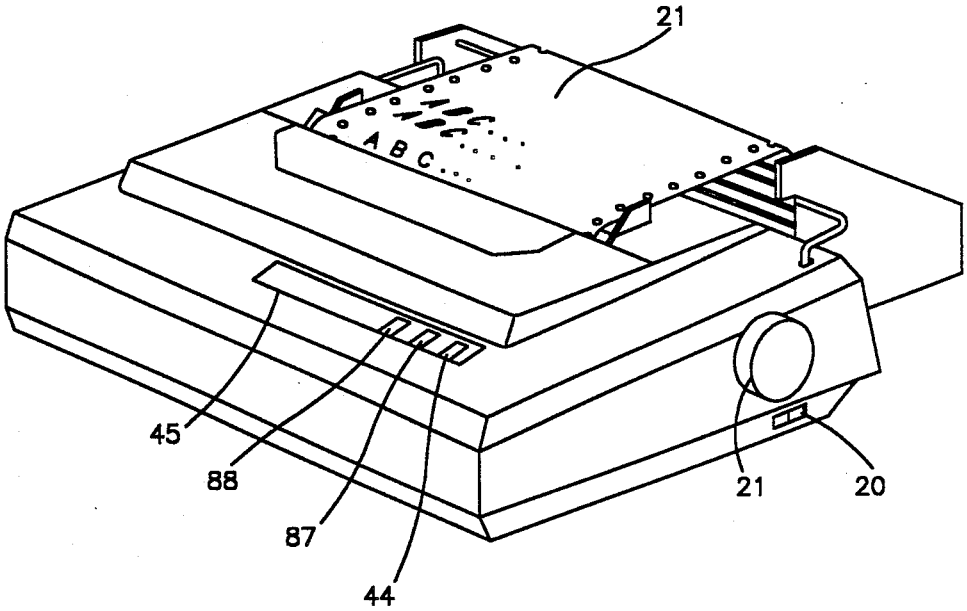
FIG. 4 is a perspective view illustrative of misalignment of printing lines.

Now, characteristic operations of the paper feed compensating device of one embodiment of the present invention will be described with reference to FIGS. 4, 5 and 7.

When the power source switch 20 of the printer is turned on, the printer is brought into the active state and the master CPU 33 initializes the printer (block 81 of FIG. 7) by a program (based on the flow chart of FIG. 7) stored in the ROM 41. That is, the master CPU 33 provides the slave CPU 34 with paper feed initializing data to rotate the paper feed motor 47 by several steps (for example, 5 steps) in the reverse direction and subsequently by 5 steps in the forward direction. After the initialization, the master CPU 33 monitors the turning on and off of the pause switch 44 from the port 39 (blocks 82 and 83 of FIG. 7). If the pause switch 44 is not operated by the operator, blocks 82 and 83 are both NO.

In this state, the master CPU 33 checks whether or not the printing character information is stored in the RAM 42 from an input device (not shown) through the interface circuit 43 and the port 38. If the printing character information is stored in it, the master CPU 33 analyzes the information and applies information necessary for printing, such as paper feed data, printing character data, and printing position data, to the slave CPU's 34, 35 and 36, respectively. On the basis of these data, these slave CPU's 34, 35 and 36 drive the drive circuits 48, 50, 53, 55 and 58 to print the characters (block 85 of FIG. 7) and repeat these operations.

Now, if the operator actuates the external pause switch 44 (FIG. 4) to bring the printer into the pause state (the state in which printing is stopped), the master CPU 33 judges it (block 82 of FIG. 7). In the pause state, the mater CPU 33 analyzes inputs of L.F. (line feed) switch 87 and F.F. (form feed) switch 88 on the control panel 45 (FIG. 4) to perform operations such as line feed and form feed (block 90 of FIG. 7). In the pause state, further, the operator performs line alignment and form feed manually through the platen knob 22. Said causes for misalignment in printing lines in the paper feed device which are initialized and compensated in block 81 originate from this manual operation.

Now if the operator actuates the pause switch 44 to release the pause state, the master CPU 33 judges it (blocks 82 and 83 of FIG. 7). In this state, the master CPU 33 initializes the paper feed device again. That is, in the operation described hereinabove, the master CPU 33 rotates the paper feed motor 47 by five steps in the reverse direction (block 91 of FIG. 7) and then by five steps in the forward direction (block 92 of FIG. 7). This is the characteristic feature of the present invention. Thereafter, the flow returns to block 82 and repeats the above-described operations.

While the paper feed device in this embodiment is described as being initialized in five steps, it will be obvious that this is not limited to five steps.

INDUSTRIAL APPLICABILITY

As described above, the present invention is so constructed that detection of deviation of the daisy wheel is performed automatically at the time of printing the reference position character and at the time of detecting the detection of deviation command signal. Accordingly, the present invention provides a significant meritorious effect that detectin of deviation of the daisy wheel can be performed periodically without depending upon the printing character and detection of deviation can be performed even when printing character information which does not include a reference position character is printed continuously, and thereby makes accurate printing possible.

Further, the present invention is so constructed that adjustment of the paper feed device is performed automatically even immediately after the pause mode of the printer has been released. Accordingly, the present invention provides another significant meritorious effect in that misalignment in printing lines can be prevented even when the operator eeds paper manually.

We claim:

1. A method of operating a printer, said method comprising the steps of printing on paper when a pause switch is in an unactuated condition, said step of printing on paper including operating a paper feed motor to index the paper, stopping the printing on the paper by manually operating the pause switch from the unactuated condition to an actuated condition, initiating resumption of printing on the paper by manually operating the pause switch from the actuated condition to the unactuated condition, and, in response to manual operation of the pause switch from the actuated condition to the unactuated condition and prior to resuming printing, compensating for any misalignment in printing lines which occurred when the pause switch was in the actuated condition, said step of compensating for any misalignment in printing lines being performed in response to actuation of the pause switch from the actuated condition to the unactuated condition and including operating the paper feed motor in a first direction to index the paper through a predetermined number of steps in one direction and immediately thereafter operating the paper feed motor in a second direction to index the paper through a predetermined number of steps in a direction opposite to the one direction.

2. A printing apparatus comprising printer means for printing on paper, paper feed motor means for indexing the paper relative to said printer means, a manually actuatable pause switch operable between an actuated condition and an unactuated condition, and control means connected with said printer means, paper feed motor means and pause switch for effecting operation of said printer means and said paper feed motor means to sequentially print a series of lines of print on the paper when said pause switch is in the unactuated condition and for stopping printing on the paper upon manual operation of said pause switch from the unactuated condition to the actuated condition, said control means including means for initiating resumption of printing in response to manual operation of said pause switch from the actuated condition to the unactuated condition, said means for initiating resumption of printing including compensation means for compensating for any misalignment in printing lines which occurred when the pause switch was in the actuated condition, said compensation means including means responsive to manual operation of said pause switch for operating said paper feed motor means in a first direction to index the paper through a predetermined number of steps in one direction and for immediately after indexing the paper in the one direction operating the paper feed motor means in a second direction to index the paper through a predetermined number of steps in a direction opposite to the one direction in response to manual operation of said pause switch from the actuated condition to the unactuated condition.

3. A printing apparatus comprising a motor for feeding paper, a first means for setting a pause mode and for releasing the pause mode, said printing apparatus further comprising:

detector means for detecting the releasing of the pause mode by said first means; and control means for operating said motor several steps in a first direction and for operating said motor several steps in a second direction opposite to the first direction in response to said detector means detecting the releasing of the pause mode by said first means, said control means operating said motor means for the same numer of steps in the first and second directions in response to said detector means detecting the releasing of the pause mode.

* * * * *